United States Patent [19]

Nishimoto

[11] Patent Number: 4,655,115

[45] Date of Patent: Apr. 7, 1987

[54] ELECTRONIC MUSICAL INSTRUMENT USING AMPLITUDE MODULATION WITH FEEDBACK LOOP

[75] Inventor: Tetsuo Nishimoto, Hamamatsu, Japan

[73] Assignee: Nippon Gakki Seizo Kabushiki Kaisha, Hamamtsu, Japan

[21] Appl. No.: 644,139

[22] Filed: Aug. 23, 1984

Related U.S. Application Data

[63] Continuation of Ser. No. 418,539, Sep. 15, 1982, abandoned, and a continuation of Ser. No. 197,652, Oct. 16, 1980, abandoned.

[30] Foreign Application Priority Data

Oct. 26, 1979 [JP] Japan ..... 54-138534

[51] Int. Cl.[4] ..... G10H 1/08; G10H 1/14

[52] U.S. Cl. ..... 84/1.19; 84/1.22; 84/DIG. 10

[58] Field of Search ..... 84/1.01, 1.19, 1.22, 84/1.24, 1.25, 1.26, DIG. 10; 307/264; 328/175

[56] References Cited

U.S. PATENT DOCUMENTS

| | | | |
|---|---|---|---|
| 2,221,188 | 11/1940 | Hammond et al. | 84/1.25 |
| 3,007,361 | 11/1961 | Wayne, Jr. | 84/1.01 |
| 3,157,725 | 11/1964 | Wayne, Jr. | 84/1.24 |
| 4,114,498 | 9/1978 | Chibana et al. | 84/1.19 |
| 4,135,424 | 1/1979 | Okamoto | 84/1.26 X |
| 4,189,972 | 2/1980 | Yamada et al. | 84/1.25 |
| 4,281,574 | 8/1981 | Deutsch | 84/1.19 |

*Primary Examiner*—Stanley J. Witkowski

*Attorney, Agent, or Firm*—Spensley Horn Jubas & Lubitz

[57] ABSTRACT

In a musical tone synthesizer in which an amplitude-modulated carrier wave delivered from an amplitude modulator is used to form a musical tone signal, the amplitude-modulated carrier wave is fed back to the input side of the amplitude modulator as a modulation signal, a portion thereof, a portion of a carrier wave or a composite signal of the modulation signal and the carrier wave. The amount of feedback may be controlled by multiplying the amplitude-modulated carrier wave with a predetermined modulation index. Furthermore, the modulation index may be charged with time so that the control of spectrum construction of the musical tone signal is readily performed. According to a modified embodiment, a plurality of amplitude-modulators are provided which are connected in a ring form feedback loop in which the modulated outputs of preceding amplitude modulators are supplied respectively to succeeding amplitude modulators.

34 Claims, 33 Drawing Figures

ELECTRONIC MUSICAL INSTRUMENT USING AMPLITUDE MODULATION WITH FEEDBACK LOOP

RELATED APPLICATIONS

The present application is a continuation of application Ser. No. 418,539 filed Sept. 15, 1982, now abandoned, and a continuation of application Ser. No. 197,652 filed Oct. 16, 1980, now abandoned.

BACKGROUND OF THE INVENTION

This invention relates to an electonic musical instrument, and more particularly a musical tone synthesizing apparatus for synthesizing a musical tone by utilizing amplitude modulation.

The art of synthesizing a musical tone rich in harmonics by utilizing an amplitude modulation is disclosed in Japanese Prelimary Publication of Pat. No. 48720/1978. According to this method, an input signal $F(\omega t)$ is multiplied with a predetermined modulation function and the resulting side band is used as harmonic components. With this method, however, it is necessary to provide a function generator which generates the predetermined modulation function. In addition, when used is a complicated modulation system which employs a polynomical or multiplexing modulation technique to produce much more harmonic components, thus increasing the number of modulators and enlarging the size of the musical tone synthesizing apparatus.

SUMMARY OF THE INVENTION

Accordingly, it is an object of this invention to provide an improved electronic musical instrument of an extremely simple construction which can synthesize a musical tone rich in harmonic components.

The above mentioned simple construction is accomplished by feeding back an amplitude modulated signal to the input side of the amplitude modulator. To be more concrete, the amplitude modulated signal is fed back to the amplitude modulator, as a modulation signal, a portion thereof or a portion of carrier wave or as a composite signal of the modulation signal and the carrier wave. The amount of feedback is controlled by multiplying the modulated output with a predetermined modulation index. According to this invention there is provided an electronic musical instrument comprising keyboard means having a plurality of keys, means for generating a carrier wave having a frequency corresponding to a depressed key, amplitude modulator means for amplitude-modulating the carrier wave in accordance with a modulation signal and for delivering an amplitude-modulated carrier wave to be used for producing a musical tone signal, and feedback means for generating the modulation signal in accordance with the amplitude-modulated carrier wave.

According to a modified embodiment, a plurality of amplitude modulators are provided which are connected in a ring form feedback loop in which the modulated outputs of preceding amplitude modulators are supplied to succeeding amplitude modulators as a modulation signal.

BRIEF DESCRIPTION OF THE DRAWINGS

Further objects and advantages of this invention can be more fully understood from the following detailed description taken in conjunction with the accompanying drawings in which.

DESCRIPTION OF THE PREFERRED EMBODIMENTS

Figure 1:
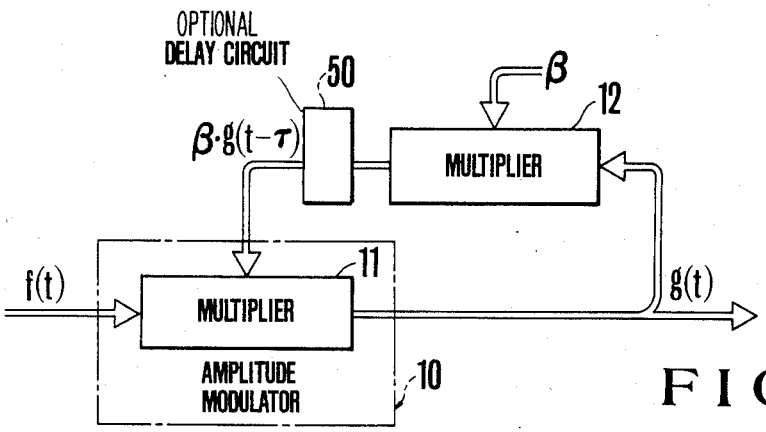
FIG. 1 is a block diagram showing the basic construction of one example of a musical tone synthesizer of an electronic musical instrument according to this invention.

Referring to FIG. 1 of the accompanying drawing, which shows the basic construction of this invention, the output g(t) from an amplitude modulator 10 of the electronic musical instrument according to this invention is multiplied with a modulation index $\beta$ and then fed back as a modulation signal. The amplitude modulator 10 comprises a multiplier 11 which operates to multiply a signal to be modulated or carrier wave f(t) with a modulation signal $\beta \cdot g(t-\tau)$ to obtain the modulated output signal g(t). A multiplier 12, which multiplies the modulated output g(t) with the modulation index $\beta$, is inserted in the feedback loop for the modulated output g(t) to obtain the modulation signal $\beta \cdot g(t-\tau)$. The symbol $\tau$ represents a delay time of the feedback loop inherent to the multipliers 11 and 12. This delay time $\tau$ prevents the modulated output g(t) from being multiplied infinitely with the modulation index $\beta$ and the carrier wave f(t) not to become saturated or not to converge to zero. If the delay time $\tau$ caused by the multipliers 11 and 12 is not sufficiently long, a delay circuit may be inserted at a suitable position of the feedback loop. In FIG. 1, delay circuit 50 is inserted in a feedback loop between a multiplier 12 and the amplitude modulator 10.

By the circuit construction described above, the modulated outputs g(t) are synthesized into a musical tone signal, and the musical tone signal, i.e., the modulated output g(t) is shown by the following equation.

$$g(t)=f(t)\beta\cdot g(t-\tau) \quad (1)$$

Since only the modulated output g(t) is utilized as the modulation signal the frequencies of the carrier wave f(t) and the modulation signal $\beta\cdot g\ (t-\tau)$ can be considered to be almost same. Consequently, the harmonic components of the musical tone signal g(t) obtained by amplitude modulating the carrier wave f(t) in accordance with the modulation signal $\beta\cdot g(t-\tau)$ having the same frequency as the carrier wave f(t) have a harmonic relation. Thus this invention can readily obtain a modulated output g(t) of harmonic construction suitable for use as a musical tone signal.

In FIG. 1, the fundamental frequency of the musical tone signal, i.e., the modulated output g(t) is determined by the carrier wave f(t). Accordingly, where the circuit is constructed such that the carrier wave f(t) with a frequency corresponding to a desired tone pitch is generated and when the carrier wave f(t) is applied to the multiplier 11, a musical tone signal g(t) having the desired tone pitch can be produced. One example of the circuit for producing the carrier wave f(t) is shown in FIG. 2.

Figure 2:
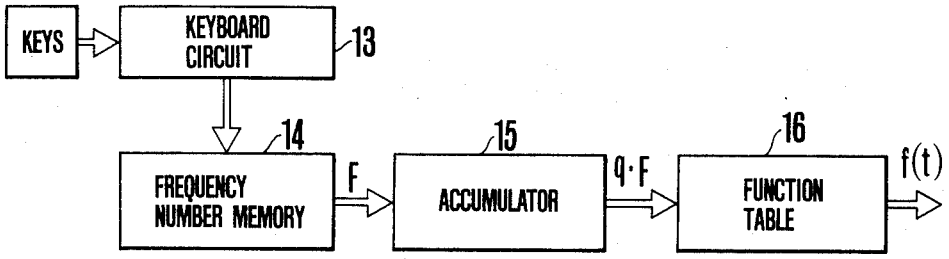
FIG. 2 is a block diagram showing one example of a circuit utilized in the electronic musical instrument shown in FIG. 1 for generating a carrier wave and having a predetermined frequency.

In FIG. 2, a signal representing a key depressed on a keyboard, not shown, is supplied from a keyboard circuit 13 to a frequency number memory 14 forming a portion of a phase angle generator, and a frequency number F (a constant representing a phase increments) corresponding to the tone pitch of the depressed key is read out from the memory 14 at a regular time interval thus obtaining a variable qF or a phase angle information which periodically increases at a period corresponding to the tone pitch of the depressed key where qF has a modulo M and q sequentially increases as 1, 2, 3 . . . This variable qF is applied to an address input, which designates phase angle, of a function table 16 to read out a predetermined function f(t).

The frequency number F and the variable qF are expressed in terms of digital quantities. Suppose now that the function f(t) read out from the function table 16 is also expressed in terms of a digital quantity, the multipliers 11 and 12 (FIG. 1) are also of the digital type. In such a case, of course the resulting modulated output g(t) is converted into an analog quantity through a digital to analog converter and then utilized to produce a musical tone. Where the modulation index $\beta$ is variably controlled with time, the harmonic components of the modulated output g(t) varies with time to provide an effect similar to that of a filter the amplitude-frequency characteristics of which vary with time. Therefore instead of variably controlling the index $\beta$, the above-mentioned filter may be used. The method of producing the carrier wave f(t) is not limited to that shown in FIG. 2. Thus, the carrier wave f(t) may be given by an analog signal or by any other methods.

Figure 3:
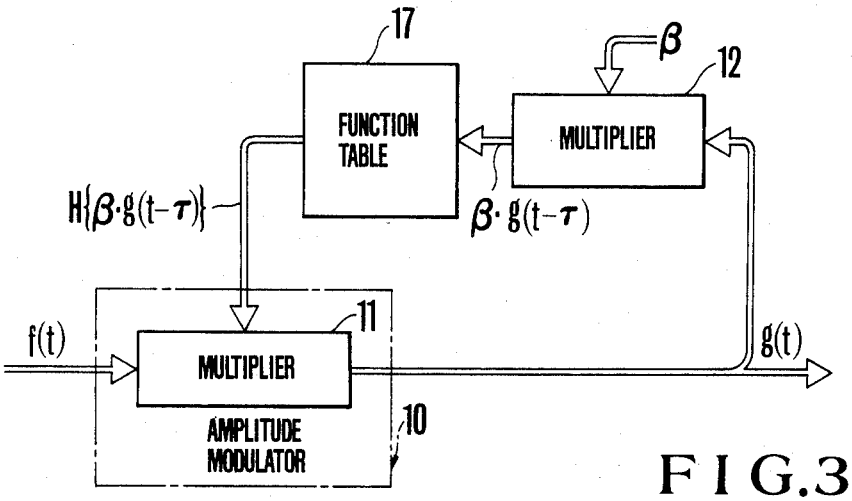
FIG. 3 is a block diagram showing a modified embodiment of this invention.

FIG. 3 shows an example in which a function table 17 is inserted in a feedback loop for the modulated output g(t). More particularly, the function table 17 is read out by using the product of the modulated output g(t) and the modulation index obtained by the multiplier 12 as a parameter, and a function read out from the function table 17 is supplied to the multiplier 11 as a modulation signal. It is advantageous that the functions to be stored in the function table 17 are preferred that when the input is zero, an output of a constant value other than zero would be produced. Then, even when the modulation index $\beta$ becomes zero, a constant value other than zero is applied to the multiplier 11 as the modulation signal to obtain an output g(t) having the same waveform as the carrier wave f(t) thereby decreasing the limit upon the range in which the modulation index $\beta$ is set. When the function to be stored in the function table 17 is denoted by H, the modulated output g(t) can be expressed by the following equation (2)

$$g(t)=f(t)\cdot H\{\beta\cdot g(t-\tau)\} \quad (2)$$

Thus, the tendency of the waveform of the modulated output, that is the musical tone signal g(t) is determined by the function H, which may be a cosine function for example.

Figure 4:
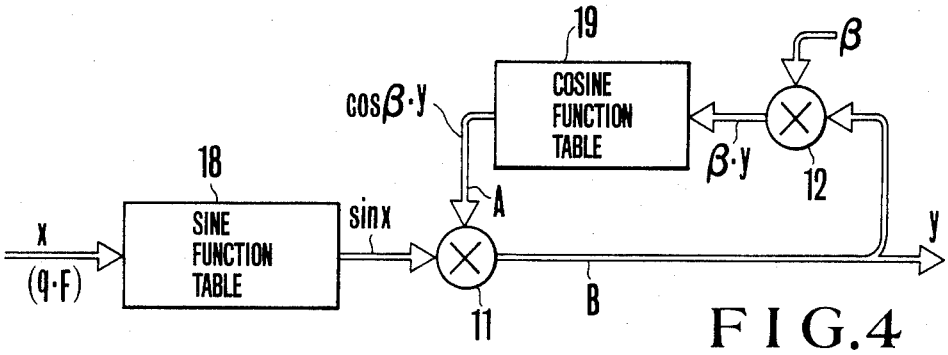
FIG. 4 is a block diagram showing the detail of the circuit shown in FIG. 3.

FIG. 4 shows one example wherein the function H to be stored in the function table 17 in FIG. 3 is a cosine function and the carrier wave f(t) is a sine function. An address input x to a sine function table 18 is the same as the variable qF delivered from the accumulator 15 shown in FIG. 2, and a sine function sin x is read out from the sine function table 18 at a frequency corresponding to a desired tone pitch. This sine function sin x is applied to the multiplier 11 as a carrier wave and an amplitude modulated output produced by the multiplier 11 is shown by y which is multiplied with the modulation index $\beta$ in the multiplier 12 and the resulting product $\beta y$ is applied to the cosine function table 19 as an address input. A consine function cos $\beta y$ read out from the cosine function table 19 is supplied to the multiplier 11 as a modulation signal.

A musical tone signal, that is the modulated output synthesized by the circuit shown in FIG. 4 is expressed by the following equation (3).

$$Y=\sin x\cdot\cos\beta y \quad (3)$$

The righthand term of equation (3) can be developed in the following manner.

$$Y=\tfrac{1}{2}\{\sin(x+\beta y)+\sin(x-\beta y)\} \quad (4)$$

Let us consider the musical tone signal y (musical tone amplitude value) expressed by equation (4) from various view points.

Figure 5:
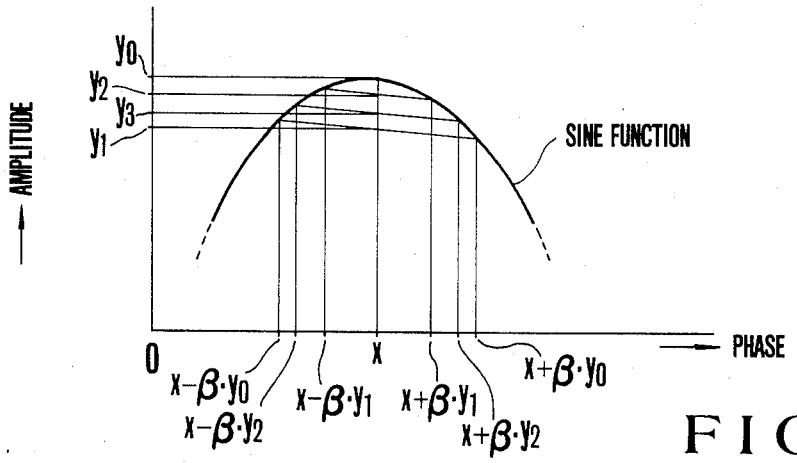
FIG. 5 is a graph showing the manner of determining the amplitude value at an instant using an equation for calculating the amplitude value of a musical tone synthesized by the circuit shown in FIG. 4.

First, let us consider how the amplitude value y shown in equation (4) is determined. In equation (4) when a phase value x is given, the value of $y_0=\frac{1}{2}(\sin x+\sin x)=\sin x$ is determined and then based on this value of $y_0$ an average value $y_1$ of the sines of angles $(x+\beta y_0)$ and $(x-\beta y_0)$ larger and smaller than the value of x is determined. Thus equation (4) means that the calculation described above is repeated infinitely. This state is shown in FIG. 5. Thus, $y_0$ is determined from x and then $y_1$ is determined from $(x+\beta y_0)$, and $(x-\beta y_0)$. Then $y_1$ is determined from $(x+\beta y_0)$ and $(x-\beta y_0)$, $y_2$ is determined from $(x+\beta y_1)$, and $(x-\beta y_1)$, and $y_3$ is determined from $(x+\beta y_2)$ and $(x-\beta y_2)$ and so on. Thus in the case of FIG. 5 it may be considered that the value of y becomes stable at a certain value between $y_2$ and $y_1$. Of course the repeated calculation described above is made instantly and it is herein assumed that the value of x does not vary until the value of y becomes stable. In FIG. 5, even when the value of $\beta y$ ($\beta y_0$, $\beta y_1$, $\beta y_2$ . . . ) is equal to $\beta y\pm 2n\pi$ (n is integer) it is clear that the value of the sine function obtained (and its average value) does not vary. For this reason, a range of $2\pi$ is sufficient for the absolute value $|\beta y|$ of $\beta y$. Since absolute value of y shown by equation (3) or (4) is $|y| \leqq 1$, $\beta \leqq 2\pi$ is sufficient for the range of the modulation idex $\beta$. Thus, it is sufficient to make the maximum value of the modulation index $\beta$ to be $2\pi = 6.28$.

Figure 6:
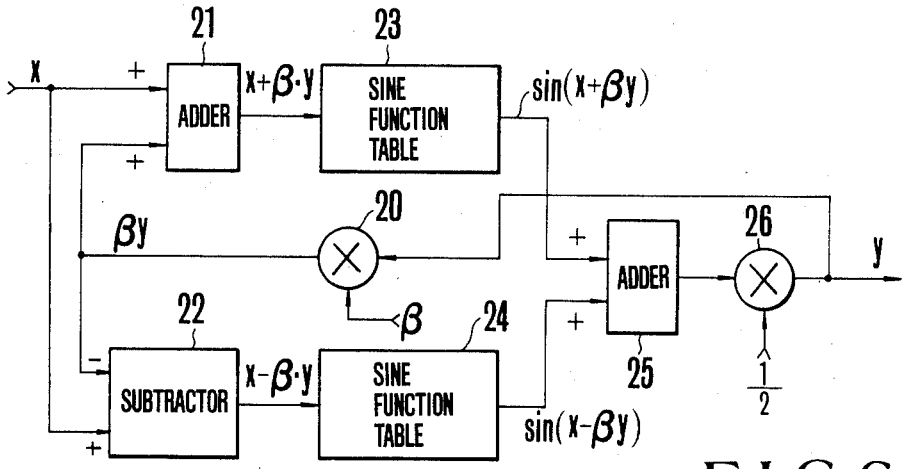
FIG. 6 is a block diagram equivalent to that shown in FIG. 4.

An equivalent circuit of FIG. 4 constructed according to equation (4) is shown in FIG. 6. In FIG. 6, a multiplier 20 multiplies the output y with the modulation index $\beta$ and feeds back its output $\beta y$ to an adder 21 and a subtractor 22. The adder 21 adds together input x and $\beta y$ and its sum output is used to read out a sine function sin $(x+\beta y)$ from a sine function table 23. In the subtractor 22, $\beta y$ is subtracted from input x and the difference output is used to read out a sine function sin $(x-\beta y)$ from a sine function table 24. Both sine functions are added together by an adder 25 and its sum output sin $(x+\beta y)+\sin(x=\beta y)$ is multiplied with $\frac{1}{2}$ by a multiplier 26 to obtain the value y shown in equation (4). In the circuit shown in FIG. 6, the amplitude value y is determined just in the same manner in FIG. 5.

Figure 7:
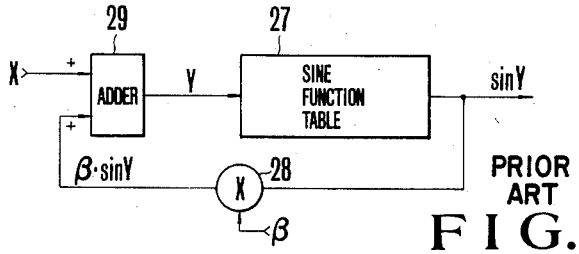
PRIOR ART FIG.7
FIG. 7 is a block diagram showing a portion of a musical tone synthesizer resembling a portion included in the circuit shown in FIG. 6.

It can be noted that the circuit construction shown in FIG. 6 is similar to the prior art circuit shown in FIG. 7. In FIG. 7, the output sin Y from a sine function table 27 is multiplied with the modulation index $\beta$ in a multiplier 28 and its output $\beta \cdot \sin Y$ is added to a variable X in an adder 29 and the output Y of the adder 29 is used to read out the sine function table 27. Analysis of a musical tone waveform sin Y obtainable with the circuit shown in FIG. 7 is described in detail in Japanese Preliminary Publication of Pat. No. 7733/1980 dated Jan. 19, 1980, (corresponding to U.S. Pat. No. 4,249,447 assigned to Nippon Gakki Co., Ltd., the same assignee as the present case), but it was confirmed that very interesting musical tone synthesis can be made as outlined in the following. The input Y to the sine function table 27 shown in FIG. 7 is expressed as follows.

$$Y = X + \beta \cdot \sin Y \tag{5}$$

As a result of analysis of this equation (5), it was confirmed that the output waveform sin Y can be expressed by the following equation $$\sin Y = \sum_{n=1}^{\infty} \frac{2}{\beta} \cdot Jn(n\beta) \cdot \sin n X \tag{6}$$

where Jn $(n\beta)$ is a Bessel function in which n designates an order and $n\beta$ represents a modulation index. Equation (6) is similar to a conventional frequency modulation theorem in that it includes the Bessel function and synthesizes a musical tone similar to the musical tone synthesis effected by frequency modulation. It has already been confirmed that, according to this invention it is possible to synthesize a musical tone having better spectrum characteristics than the synthesized by conventional frequency modulation because the order n is contained in the modulation index $n\beta$. Accordingly, the musical tone y synthesized by the circuit shown in FIG. 6 having similar construction shown in FIG. 7 also produces a musical tone sin Y obtained by FIG. 7 and manifesting excellent characteristics. However, as a result of observation of an actually measured waveform to be described later, the waveform obtainable with the circuit construction shown in FIG. 4 or 6 has a tendency of becoming rectangular showing that even order harmonics are eliminated.

Let us approximately analyze equation (4) to consider the composition of the musical signal y obtainable with the circuit shown in FIG. 4.

First, let us approximately substitute $$Y = \sin(x + \beta y)$$

for the righthand term of equation (4) putting $$x + \beta \cdot y = z \tag{8}$$

and then converting equation (8) into $$y = \frac{Z - X}{\beta} \tag{9}$$

thereafter by substituting equations (8) and (9) into equation (7), we obtain $$z - x = \beta \cdot \sin z \tag{10}$$

In equation (10) when z=0, x=0, whereas when $z=\pi$ $x=\pi$. Consequently, it will be noted that when x=0 or $x=\pi z - x = 0$, equation (10) shows some sort of a periodic function including x as a variable. This equation can be replaced as follows $$z - x = A_1 \cdot \sin x + A_2 \cdot \sin 2x + A_3 + \sin 3x + \ldots \tag{11}$$

where $$A_n = \frac{2}{\pi n} \int_0^{\pi} \cos\{n(z - \beta \sin z)\}\, dz = \frac{2}{n} Jn(n\beta) \tag{12}$$

As a consequence, equation (1) can be expressed as follows $$z = x + 2\{J_1(\beta) \cdot \sin x + \tfrac{1}{2} \cdot J_2(2\beta) \cdot \sin 2x + \tfrac{1}{3} \cdot J_3(3\beta) \cdot \sin 3x + \ldots\} \tag{13}$$

By replacing the righthand side of equation (8) with the righthand side of equation (13) and then by elimination x in the left and righthand sides to obtain $$Y = \frac{2}{\beta}\{J_1(\beta) \cdot \sin x + \tfrac{1}{2} \cdot J_2(2\beta) \cdot \sin 2x + \tfrac{1}{3} \cdot J_3(3\beta) \cdot \sin 3x + \ldots\} \tag{14}$$

where $\beta \neq 0$. Thus, it can be noted that the righthand first term of the equation (4) can be approximately developed as shown in equation (14).

In the same manner, the righthand second term of equation (4) is approximately replaced as $$Y = \sin(x - \beta y) \tag{15}$$

to obtain an equation $$x - \beta \cdot y = z \tag{16}$$

then substitution of equation (16) into equation (15) results in an equation $$z - x = -\beta \cdot \sin z \tag{17}$$

When equation (17) is substituted by utilizing equations (11) and (12), we obtain $$Z=x-2\{J_1(\beta)\cdot\sin x+\tfrac{1}{2}\cdot J_2(2\beta)\cdot\sin 2x+\tfrac{1}{3}\cdot J_3(3\beta)\cdot\sin 3x+\ldots\} \quad (18)$$

From equations (18) and (16) we obtain $$Y=2/\beta\{J_1(\beta)\cdot\sin x+\tfrac{1}{2}\cdot J_2(2\beta)\cdot\sin 2x+\tfrac{1}{3}\cdot J_3(3\beta)\cdot\sin 3x+\ldots\} \quad (19)$$

Thus, the righthand second term of equation (2) can be approximately developed as shown in equation (19).

From the approximate analysis of equation (4) as shown in equations (14) and (19) it can be noted that the ratio of the harmonic components contained in the musical tone signal y obtained by equation (4), or equation (3) is expressed by a Bessel function and that excellent spectrum characteristics can be expected because the modulation index $n\beta$ contains an order n.

Figure 8:
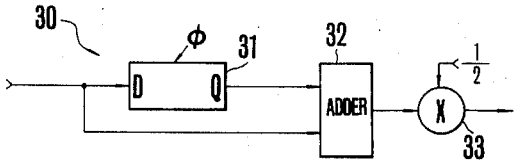
FIG. 8 is a block diagram showing one example of an averaging circuit useful to insert in the feedback circuit.

FIGS. 9 through 13 illustrate actually measured examples of the musical tone waveforms y synthesized by the circuit shown in FIG. 4. In the measurements, an averaging circuit 30 as shown in FIG. 8 was inserted at point A or B or both shown in FIG. 4. The purpose of the averaging circuit 30 is to prevent hunting phenomenon in the waveform caused by error of digital calculation where the circuit shown in FIG. 4 takes the form of a digital circuit. A delay flip-flop 31 included in the averaging circuit 30 is driven by a clock pulse $\phi$ which sets the sampling spacing of the musical tone waveform. An amplitude data regarding a preceding sampling point and delayed by the delay flip-flop 31 and the amplitude data at the present sampling points are added together by an adder 32 and the resulting sum is multiplied with $\frac{1}{2}$ with a multiplier 33 to obtain an average value of the amplitude data at two adjacent sampling points. The sampling circuit 30 functions to average the amplitudes which swing in the opposite directions at each sampling point, that is hunting, thereby eliminating undesirable hunting phenomena.

Figure 9:
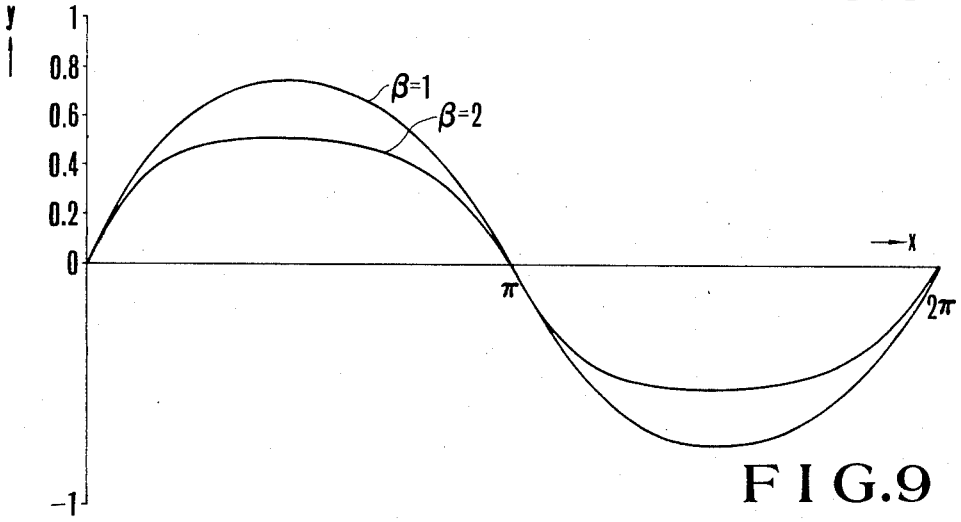
FIGS. 9 through 13 show some examples of the musical tone waveforms synthesized by the embodiment shown in FIG. 4.
Figure 10:
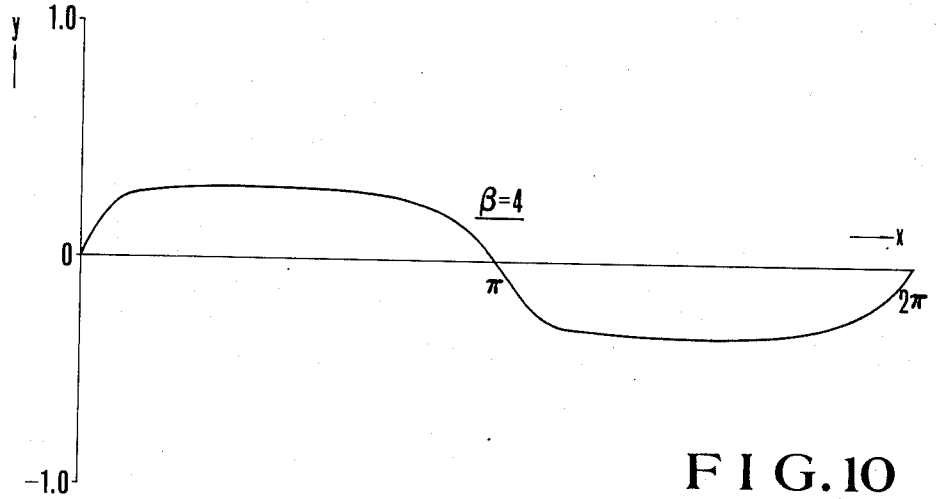
Figure 11:
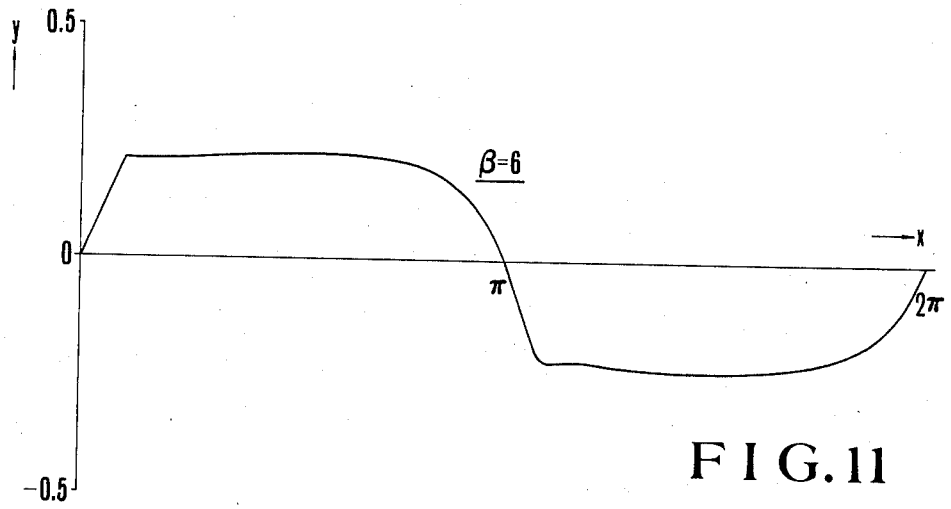
Figure 12:
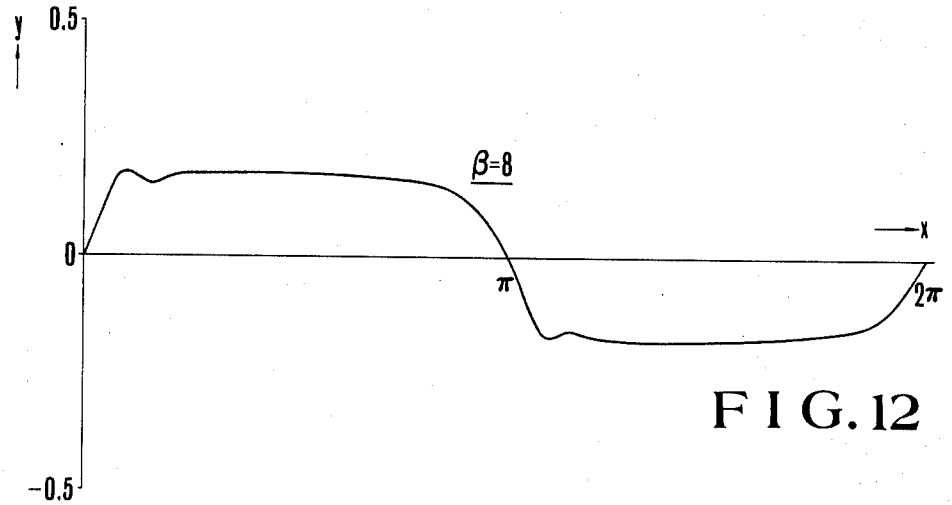
Figure 13:
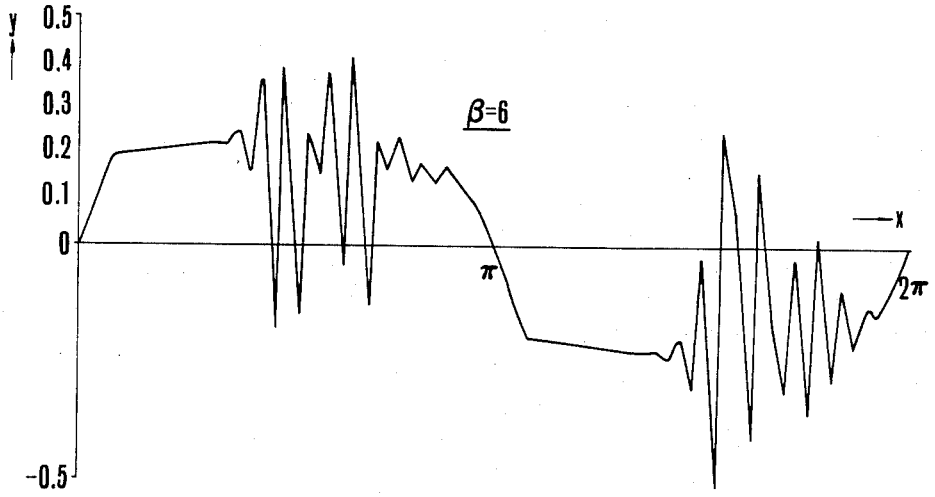

FIG. 9 shows waveforms y where $\beta=1$ and $\beta=2$. In this case, no averaging circuit 30 is used anywhere. FIG. 10 shows a waveform y when the averaging circuit 30 inserted at only point A and when $\beta=4$, whereas FIG. 11 shows a waveform y when the averaging circuits 30 are inserted at points A and B and when $\beta=6$. FIG. 12 shows a waveform y when the averaging circuits 30 and inserted at points A and B and when $\beta=8$, whereas FIG. 13 shows a waveform y when the averaging circuit 30 is inserted at point A alone and $\beta=6$. In FIG. 13, since the averaging circuit 30 is inserted at point A alone huntings occur but when the averaging circuits are inserted at both A and B points hunting does not occur as shown in FIG. 11. Although not shown, when $\beta=0$, the modulation signal cos y is fixed to unity and a waveform y becomes sine wave. The tendency of the waveform y of gradually changing from a sine wave at $\beta=0$ towards rectangular waves with increase of $\beta$ can be clearly noted from FIGS. 9 through 12.

Figure 14:
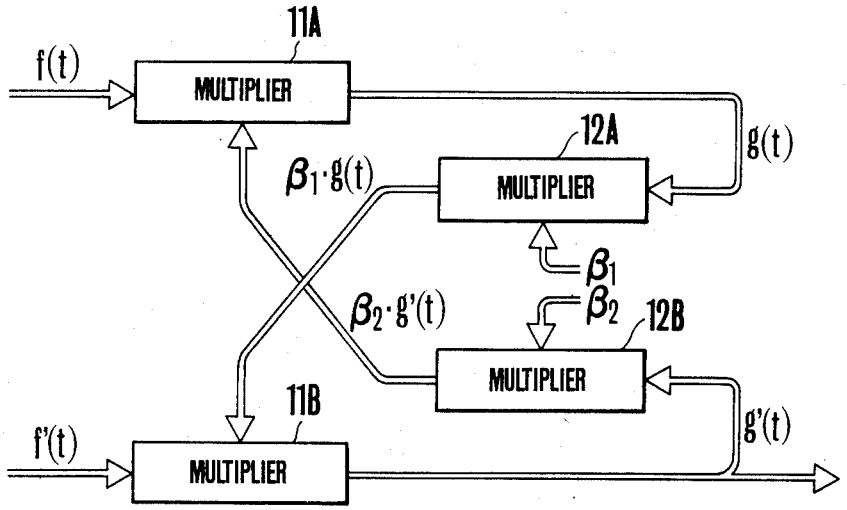
FIG. 14 is a block diagram showing the basic construction of another embodiment of this invention.

FIG. 14 shows a modified embodiment in which two amplitude modulation circuits in the form of multipliers 11A and 11B are provided and respective modulated outputs g(t) and g'(t) are applied to other modulation circuits as modulation signals without being fed back directly to their own amplitude modulation circuits, thus forming a ring shaped feedback loop (indirect feedback loop) between different amplitude modulation circuits. The modulated outputs g(t) and g'(t) are multiplied with any modulation indices $\beta_1$ and $\beta_2$, respectively in multipliers 12A and 12B and their product outputs $\beta_1\cdot g(t)$ and $\beta_2\cdot g'(t)$ are respectively applied to multipliers 11B and 11A as modulation signals. The carrier waves f(t) and f'(t) applied to respective amplitude modulators, i.e., multipliers 11A and 11B may be the same or different. Although in FIG. 14, signal g'(t) is derived out as a musical tone signal, signal g(t) may be derived out. As shown in FIG. 4, where a plurality of modulators are used and modulated outputs are used as the modulation signals for the other modulator thus forming a ring shaped feedback circuit, an interesting synthesis of the musical tone can be made as will be described later in detail.

Figure 15:
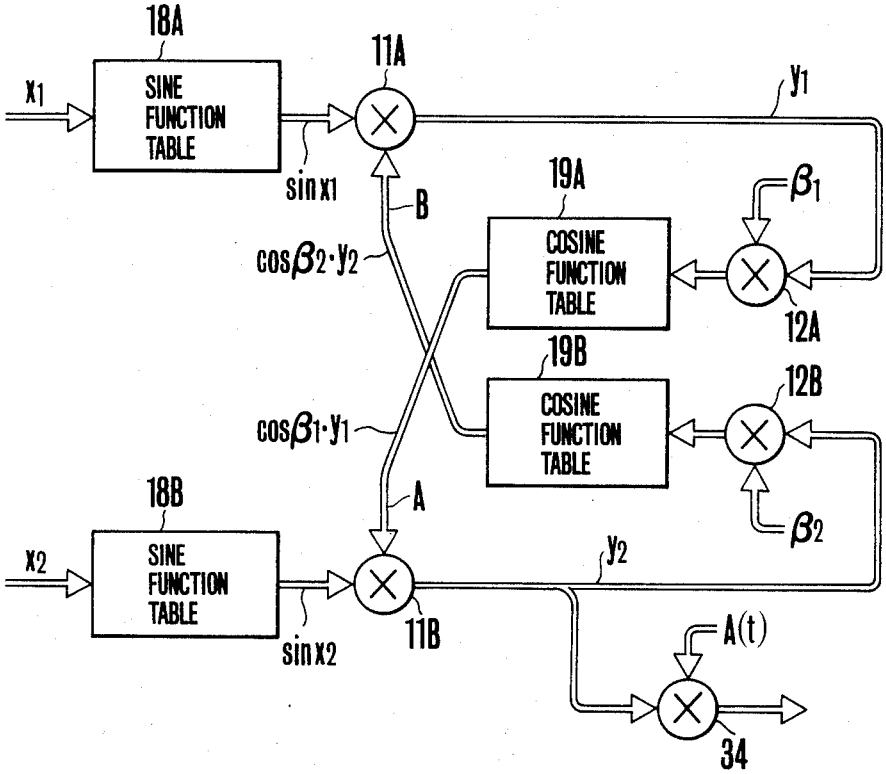
FIG. 15 is a block diagram showing the detail of the modification shown in FIG. 14.

FIG. 15 shows a modified construction in which the carrier waves f(t) and f'(t) discussed in connection with FIG. 14 are made to be sine functions, and cosine function tables 19A and 19B are read out by products of modulated outputs, the modulation indicies $\beta_1$ and $\beta_2$ and the read out outputs from the cosine function tables 19A and 19B are inputted to multipliers 11B and 11A respectively. Variables $x_1$ and $x_2$ are used to read out sine function tables 18A and 18B and read out sine functions sin $x_1$ and sin $x_2$ are applied to multipliers 11A and 11B as carrier waves. Modulated outputs $y_1$ and $y_2$ delivered from the multipliers 11A and 11B are multiplied with modulation indices $\beta_1$ and $\beta_2$ respectively with multipliers 12A and 12B and their outputs $\beta_1\cdot y_1$ and $\beta_2\cdot y_2$ are applied to the cosine tables 19A and 19B respectively and the outputs cos $\beta_1 Y_1$ and cos $\beta_2 y_2$ read out from the tables 19A and 19B are respectively supplied to multipliers 11B and 11A as modulation signals. Like the variable x utilized in FIG. 4, the values of the variable $x_1$ and $x_2$ are repeatedly varied from phase 0 to $2\pi$ at a desired repetition frequency so as to read out the sine functions sin $x_1$ and sin $x_2$ of desired frequencies. Where the modulated output $y_2$ is desired out as a musical tone signal, it is multiplied with a desired envelope signal A(t) with the multiplier 34 so as to impart well known envelope characteristics as attack, decay, etc. In FIG. 15 when $\beta_2$ is zero, the modulation signal cos $\beta_2 y_2$ applied to the multiplier 11A always becomes unity thus substantially interrupting the feedback circuit for the modulated output $y_2$. Consequently, the conventional amplitude modulation is effected in which a carrier wave sin $x_2$ is amplitude-modulated in accordance with a modulation signal not containing any components of the modulated outputs $y_2$.

Figure 16:
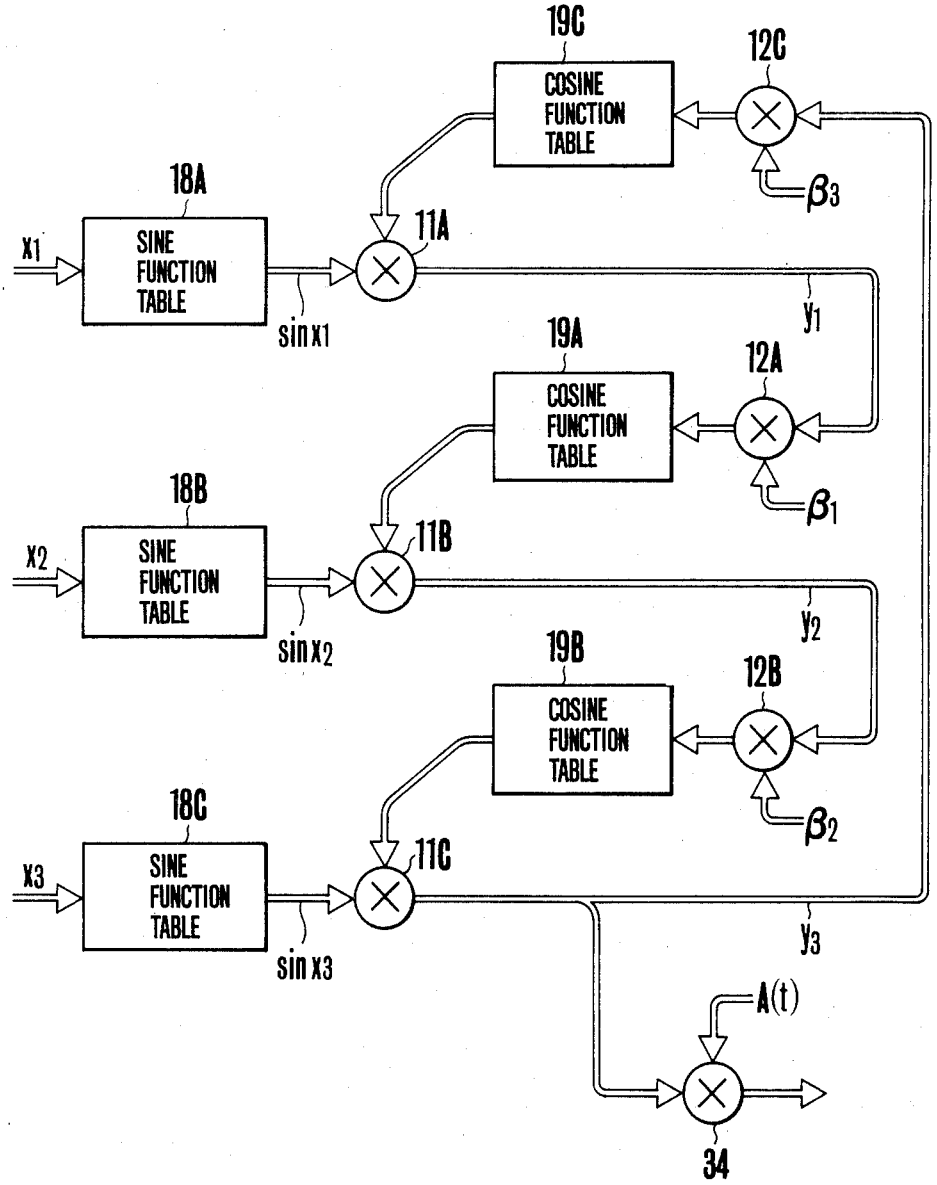
FIG. 16 is a block diagram showing a modification of the embodiment shown in FIG. 14.

FIG. 16 shows a modification of FIG. 15 which comprises three systems of amplitude modulation circuits in the form of multipliers 11A, 11B and 11C. Variables $x_1$, $x_2$ and $x_3$ are used to respectively read out sine function tables 18A, 18B and 18C and the outputs thereof sin $x_1$, sin $x_2$ and sin $x_3$ are respectively applied to multipliers 11A, 11B and 11C as signals to be modulated outputs $y_1$, $y_2$ and $y_3$ produced by multipliers 11A, 11B and 11C are respectively multiplied with modulation indices $\beta_1$, $\beta_2$ and $\beta_3$ in multipliers 12A, 12B and 12C and the outputs thereof are applied respectively to cosine function tables 19A, 19B and 19C. The outputs read out from these cosine function tables 19A, 19B and 19C are supplied to multipliers 11B,11C and 11A of other systems to act as modulation signals. The repetition frequencies of variables $x_1$, $x_2$ and $x_3$ in respective systems may be the same or different. Similarly, the modulation indices $\beta_1$, $\beta_2$ and $\beta_3$ may be the same or different. Although in FIG.

16, the modulated output $y_3$ is derived out as a musical tone signal, modulated outputs $y_1$ or $y_2$ may be derived out as the musical tone signal. In FIG. 16, where $\beta_3$ is made to zero, the feedback loop of the modulated output $y_3$ is interrupted thus providing an ordinary amplitude modulator of one multiplexing modulation type as shown in FIG. 14 or FIG. 15. The circuit shown in FIG. 16 can be expanded further, that is, more amplitude modulators may be provided in which case the modulated outputs are applied to other amplitude modulators as modulation signals, thus forming a ring shaped feedback roop constituted by a plurality of amplitude modulators. This is also true for the circuit shown in FIG. 14.

Examples of musical tone waveform $y_2$ synthesized by the circuit shown in FIG. 15 are illustrated in FIGS. 17 through 30. To measure the waveforms, averaging circuits 30 as shown in FIG. 8 are inserted at points A and B in FIG. 15.

FIGS. 17 through 24 show waveforms $y_2$ where the frequency ratio K between two signals sin $x_1$ and sin $x_2$ to be modulated is selected to be $\frac{1}{2}$. In this case, signal sin $x_1$ is 1 and sin $x_2$ is 2. The phase graduations $\pi$ and $2\pi$ along the abscissa show the phase corresponding to the variable $x_1$ of lower order sin $x_1$. FIGS. 25 through 30 show waveforms $y_2$ when the frequency ratio K of two signals sin $x_1$ and sin $x_2$ is selected to be unity.

Figure 17:
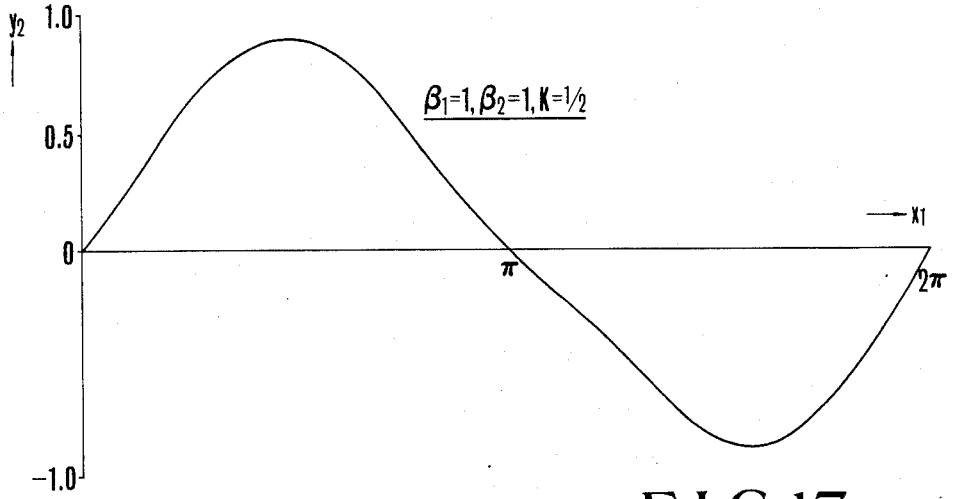
FIGS. 17 through 30 shown some examples of the musical tone waveforms synthesized by the embodiment shown in FIG. 15.
Figure 18:
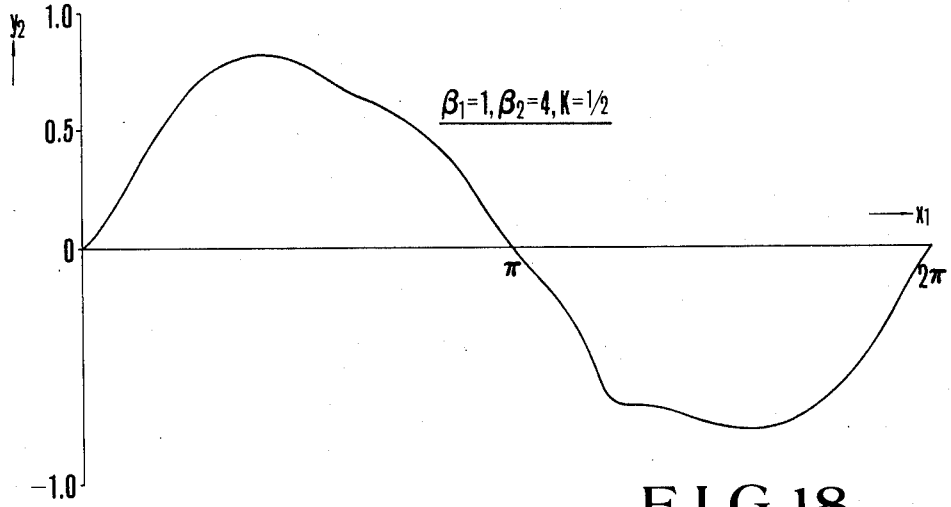
Figure 19:
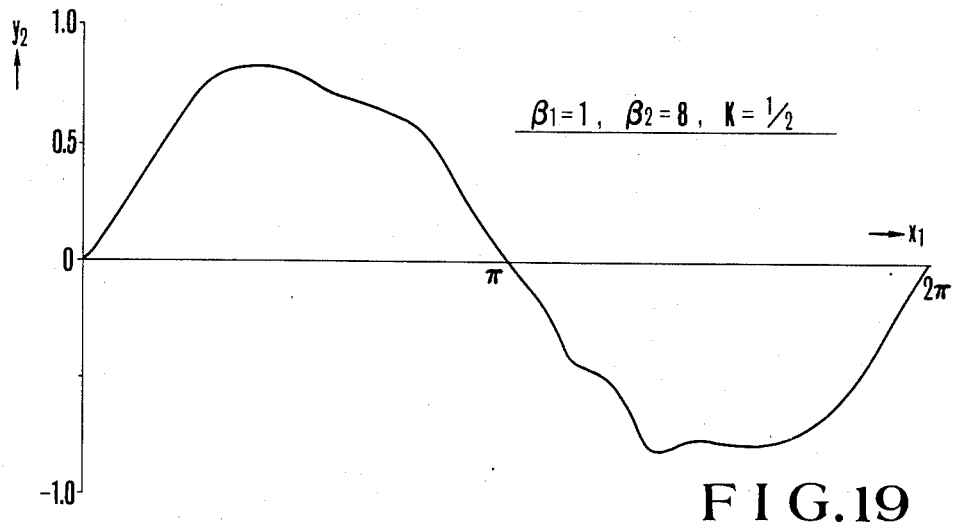

FIGS. 17, 18 and 19 show waveforms $y_2$ where $\beta_1$ is fixed to unity which $\beta_2$ is varied as 1, 4 and 8.

Figure 20:
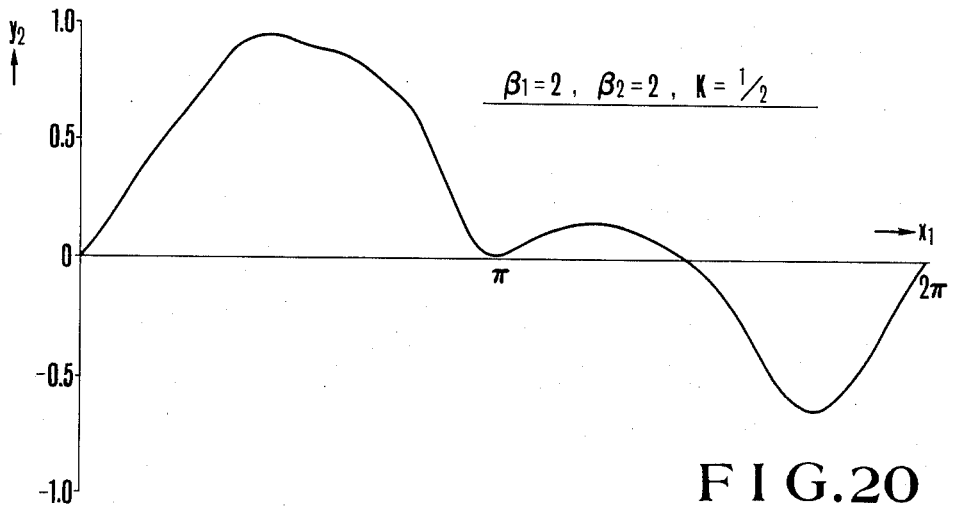
Figure 21:
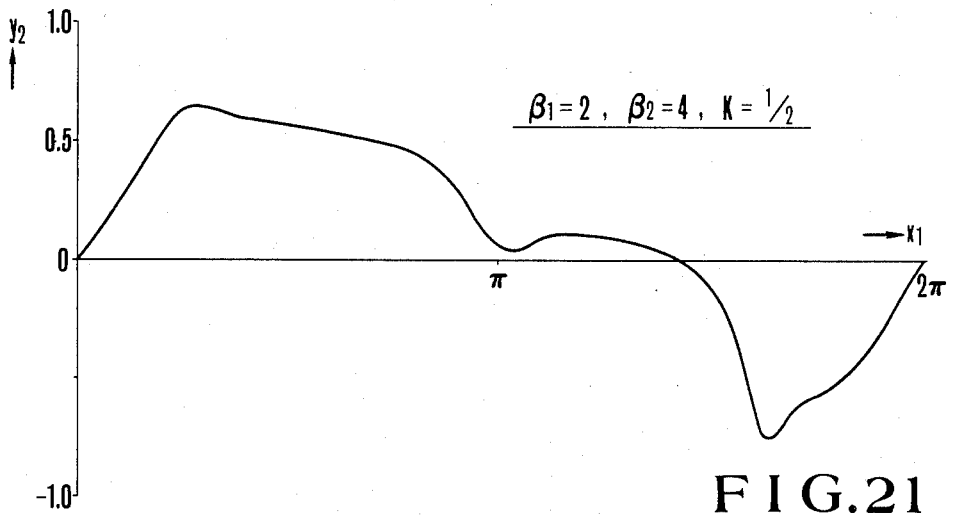
Figure 22:
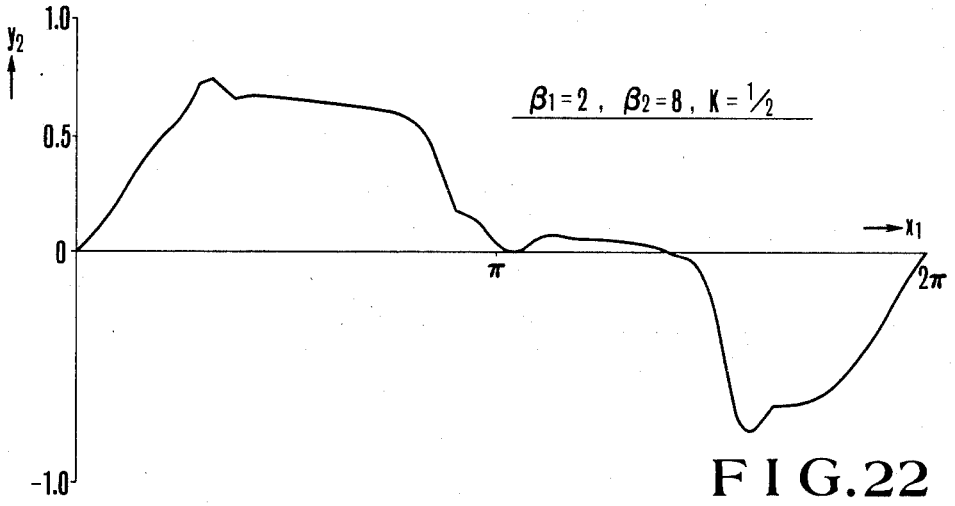

FIGS. 20, 21 and 22 shown waveforms $y_2$ when $\beta_1$ is fixed to 2 and $\beta_2$ is varied as 2, 4 and 8.

Figure 23:
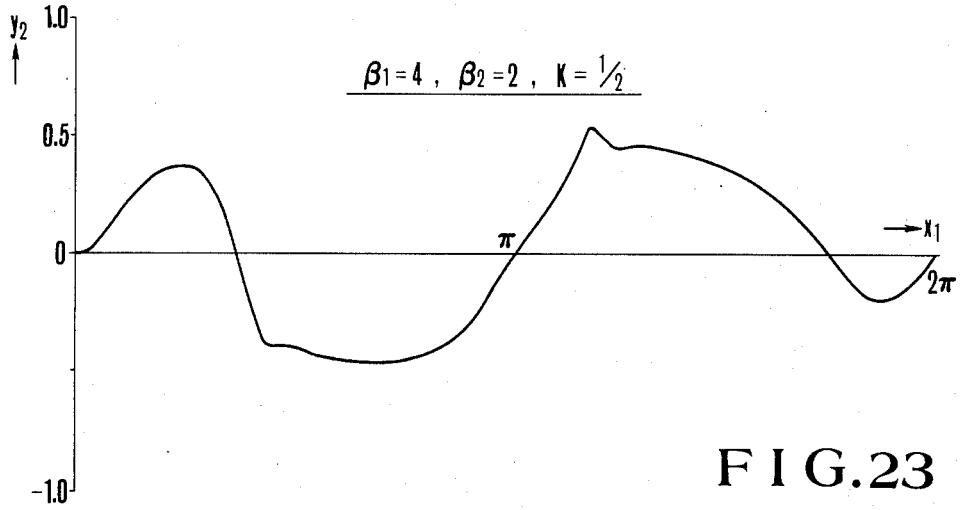
Figure 24:
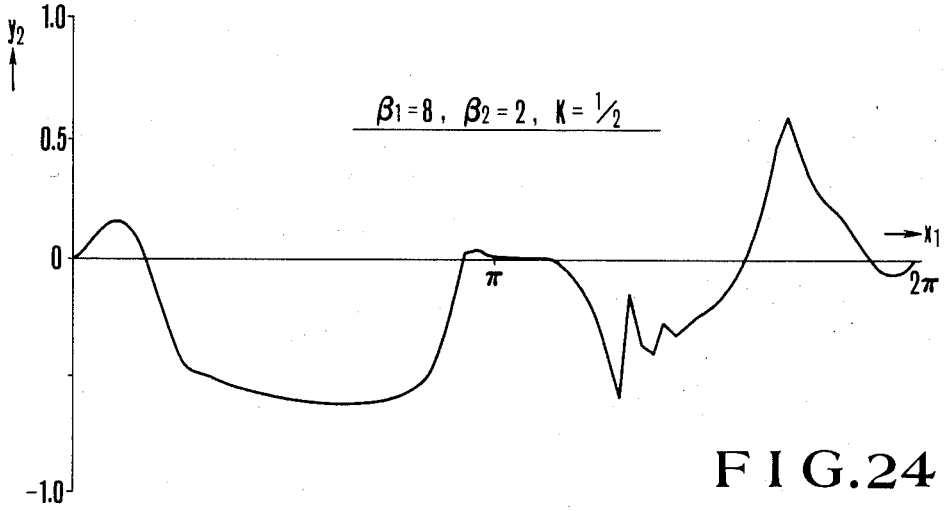

FIGS. 23 and 24 show waveforms $y_2$ where $\beta_2$ is fixed to 2, while $\beta_1$ is varied as 4 and 8. In FIG. 24 oscillation (hunting) appears at some portions.

Figure 25:
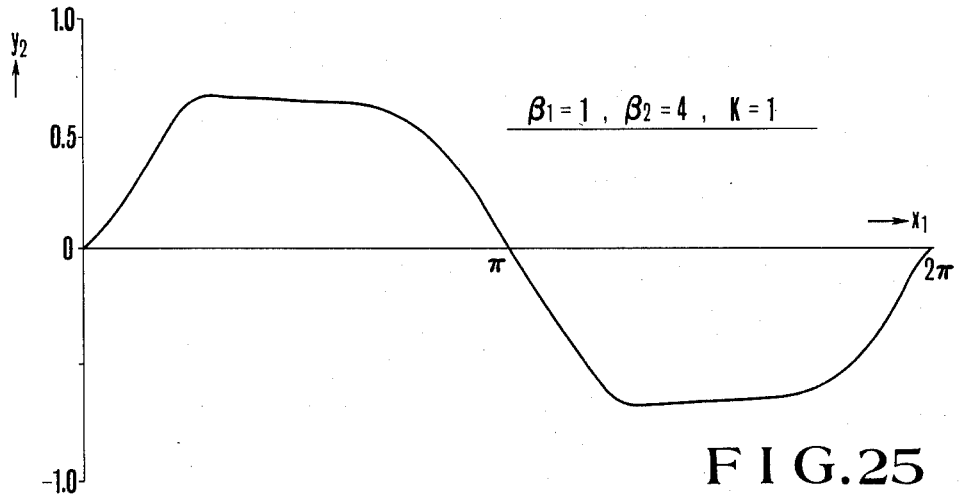
Figure 26:
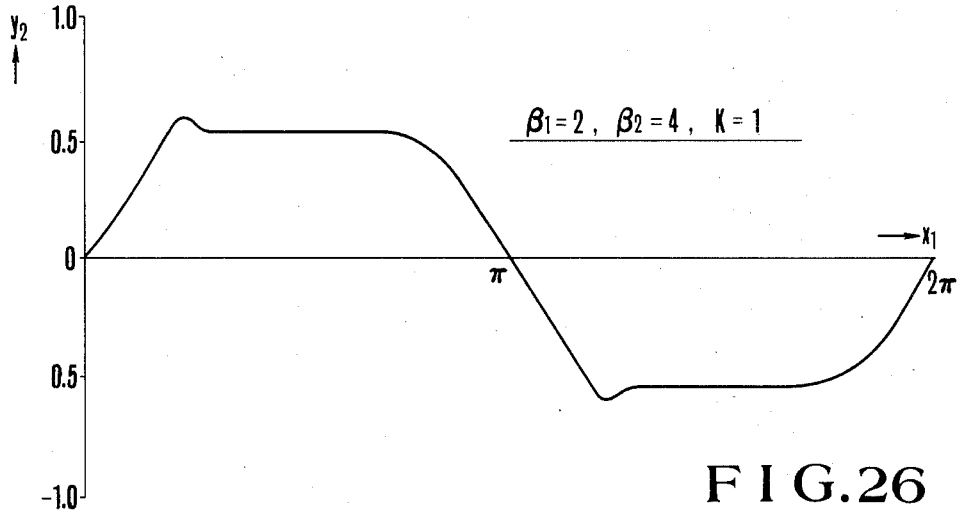
Figure 27:
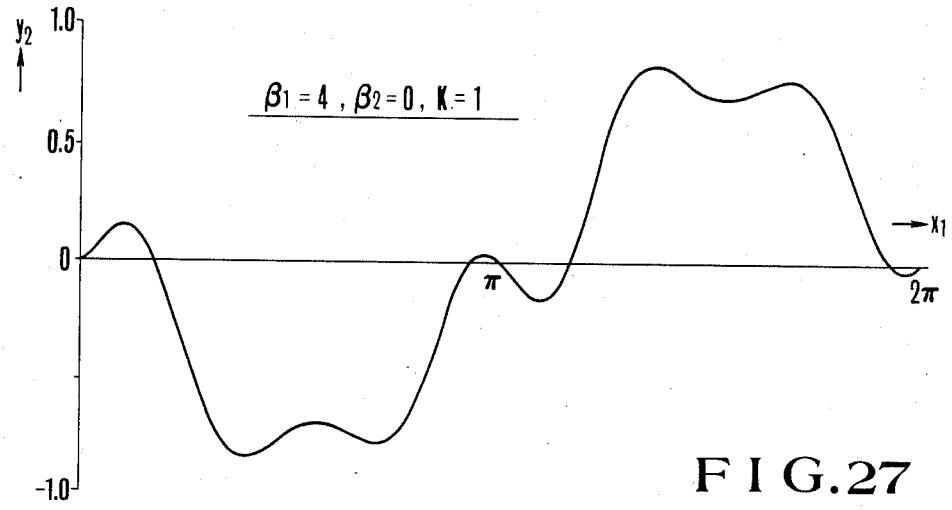
Figure 28:
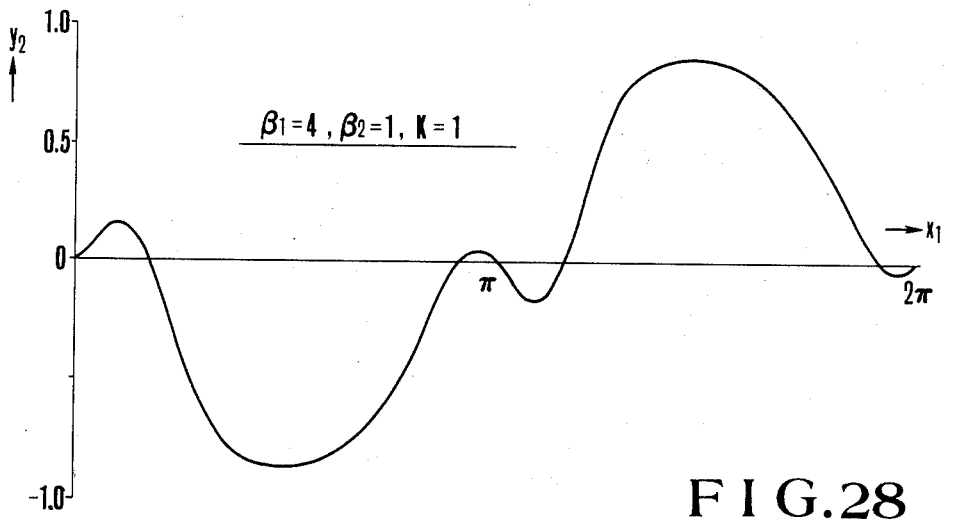
Figure 29:
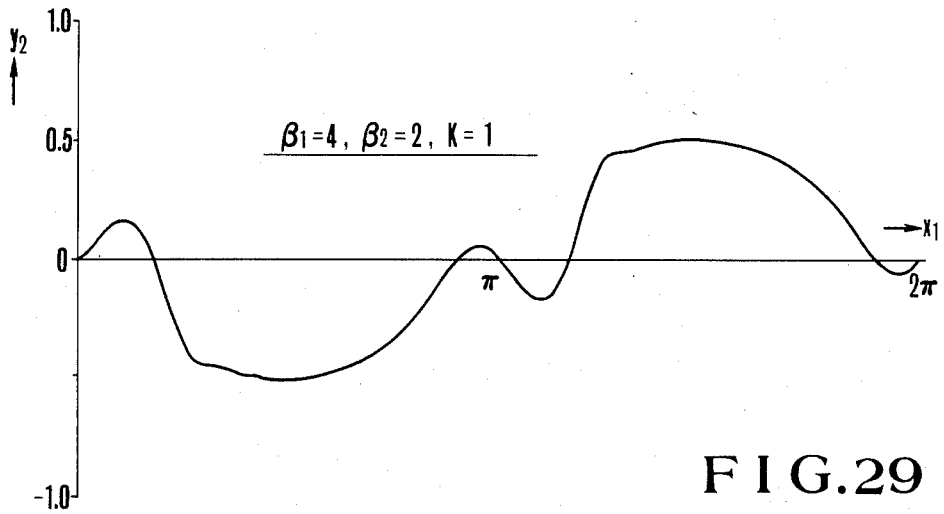

FIGS. 25 and 26 show waveforms $y_2$ where $\beta_2$ is fixed to 4 while $\beta_1$ is varied as 1 and 2.

Figure 30:
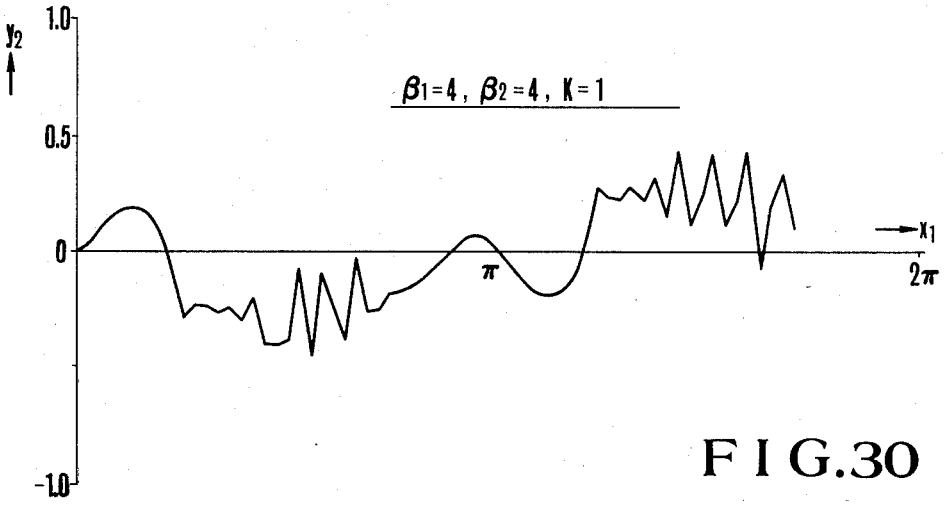

FIGS. 27, 28, 29 and 30 show waveforms $y_2$ where $\beta_1$ is fixed to 4, while $\beta_2$ is varied as 0, 1, 2 and 4. When $\beta_2=0$, the modulation is the same as conventional amplitude modulation. In FIG. 30, oscillations (huntings) occur at all portions.

FIGS. 17 through 24 shows that, with the circuit construction shown in FIG. 15, when the frequency ratio K between two signals sin $x_1$ and sin $x_2$ to be modulated is selected to be $\frac{1}{2}$ the waveform $y_2$ tends to have an acute angle and the spectrum construction of the musical tone waveform $y_2$ is expected to be that of saw tooth shape.

FIGS. 25 through 30 show that when the frequency ratio K is selected to be unity it can be expected that the spectrum construction of the waveform $y_2$ would have a tendency of that of a rectangular wave. Of course, these curves show general tendencies . . . In short, FIGS. 17 through 30 show that the spectrum construction can be varied variously by varying $\beta_1$ and $\beta_2$.

Figure 31:
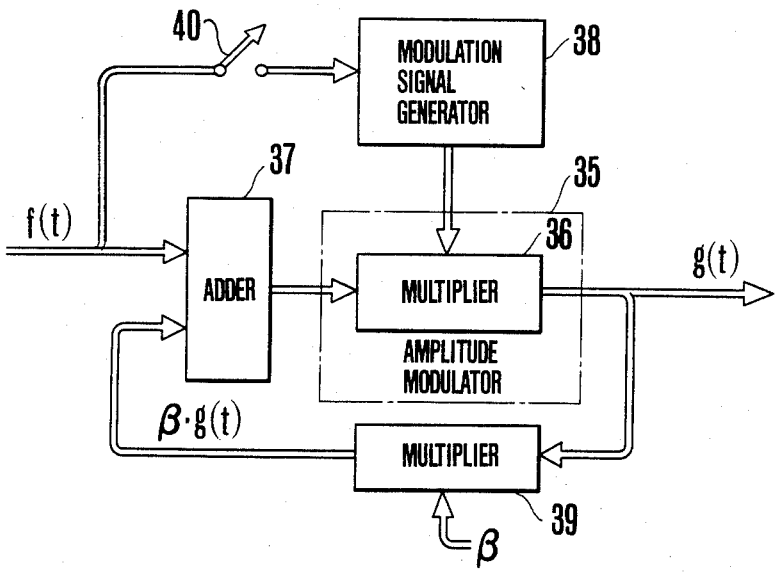
FIGS. 31, 32 and 33 are block diagrams showing still other embodiments of this invention.

FIG. 31 illustrates still another modification of the present invention in which modulated output g(t) is fed back as a portion of a carrier wave. A multiplier 36 comprising an amplitude modulator 35 is supplied with the output of an adder 37 as a carrier wave and with a suitable signal from a modulation signal generator 38 as a modulation signal. The modulated output g(t) of the multiplier 36 is multiplied with any modulation index $\beta$ in a multiplier 39 and the output thereof is fed back to adder 37. The adder 37 is supplied with an inherent carrier wave f(t) which is added to the output $\beta \cdot g(t)$ from the multiplier 39 and the sum is applied to a multiplier 36 as a carrier wave. As above described, the inherent carrier wave f(t) may be produced in accordance with a desired tone pitch, for example. By closing the switch 40, the modulation signal generated by the modulation signal generator 38 may be generated in relation to the inherent carrier wave f(t). For example, where signal f(t) comprises a sine function sin x as shown in FIG. 4, the modulation signal generator 38 is constructed to generate a cosine function B·cos x (where B represents any amplitude modulation index) having the same frequency as the sine function sin x. With the construction shown in FIG. 31 too, as the modulated output g(t) is fed back as a portion of the carrier wave, extremely interesting musical tone synthesis can be made.

Figure 32:
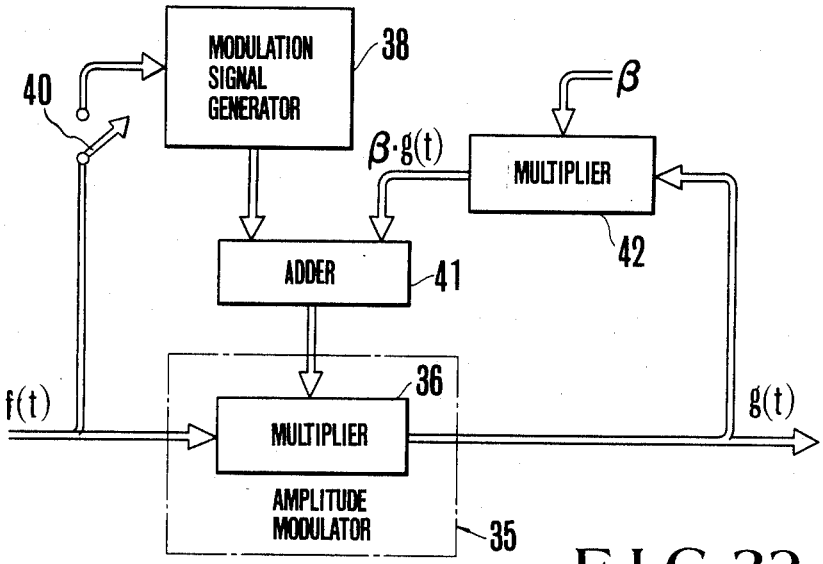

FIG. 32 shows another embodiment of the invention, in which the modulated output is made to feed back as a part of the modulation signal. To the multiplier 36 which constitutes the amplitude modulator 35 the output from the adder 41 is applied as the modulation signal. The adder 41 is made to receive the output of the multiplier 42 which multiplies the modulated output g(t) with the modulation index $\beta$ as well as to receive appropriate signals generated by the modulation signal generator 38. The switch 40 has the same function as in FIG. 31.

Figure 33:
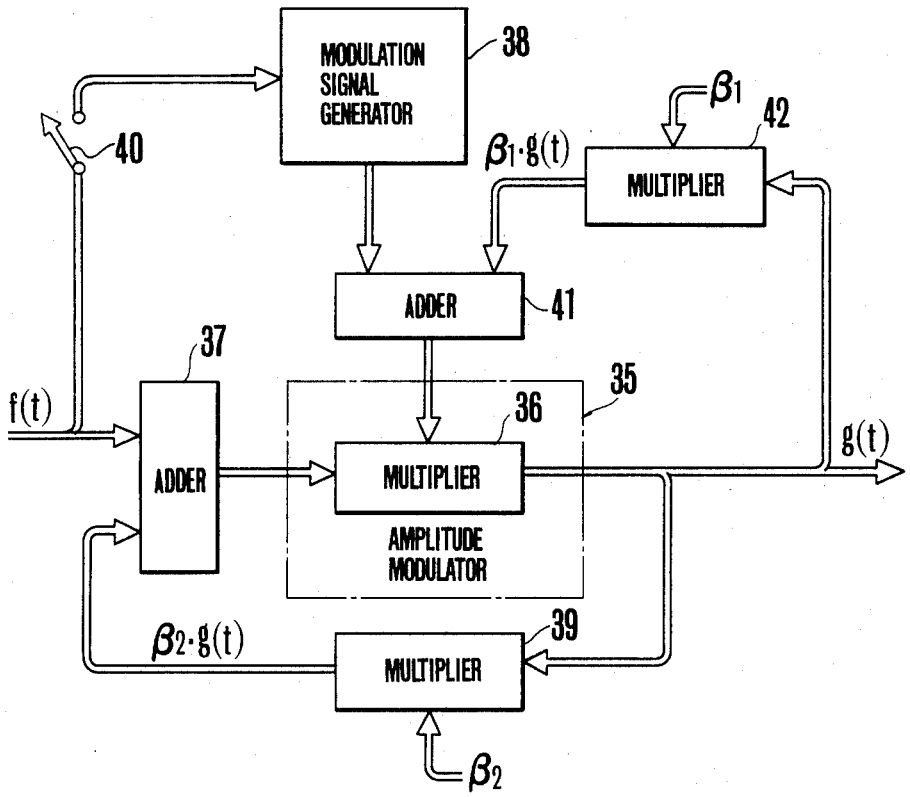

Another embodiment as shown in FIG. 33 is realized by means of composition of embodiments shown in FIGS. 31 and 32 respectively. It will be seen from this embodiment that the modulated output signal g(t) may be fed back as respective parts of both the carrier wave and the modulation signal. In FIG. 33, reference numerals 35 through 42 represent circuits having the same functions as those shown in FIGS. 31 and 32. The modulation index $\beta_1$, which defines the feedback quantity of the modulated output g(t) to the modulation signal, and the modulation index $\beta_2$, which defines the same to the carrier wave, may be set arbitrarily. According to the embodiment in FIG. 33, the modulated output g(t) is fed back in a sophisticated manner, thereby more interesting musical tones being able to be expected.

In the embodiments as shown in FIGS. 31, through 33, it is apparent that it may be possible to feed back the modulated output g(t) multiplied with the modulation index $\beta$ not directly but after converting it into a certain function as has been done in the embodiment of FIG. 3 and in that of FIG. 4 as well.

As explained above, according to the present invention, sophisticated amplitude modulation is obtained with an extremely simplified construction by feeding the modulated output back to the input side, thus musical tones having abundant spectrum constitution being simply synthesized. Further, in accordance with the invention, the control of spectrum constitution is readily performed by merely changing the parameter i.e. the modulation index $\beta$ which defines the feedback quantity.

Obviously many modifications and variations of the present invention are possible in the light of the above techniques. For example, in FIG. 16, the variables $x_1$ and $x_2$ may be related to the variation of the variable $x_3$.

What is claimed is:

1. An electronic musical instrument comprising:

keyboard means having a plurality of keys;

carrier wave generating means for generating a carrier wave having a frequency corresponding to a depressed one of said keys;

amplitude modulation means for amplitude-modulating said carrier wave by multiplying said carrier wave with a modulation signal, the resultant signal being delivered as an amplitude-modulated carrier wave to be used as a musical tone signal; and feedback means for generating said modulation signal by delaying said amplitude-modulated carrier wave and providing said delayed amplitude-modulated carrier wave as said modulation signal, whereby, as a result of said multiplying, the waveform of said musical tone signal, and hence the tone color of a musical tone corresponding thereto, will vary with the lapse of time.

2. An electronic musical instrument according to claim 1 wherein said feedback means comprises:

a first to Nth modulation signal generating means (where N is integer larger than 1) for generating respectively first to Nth modulation signals in accordance with said amplitude modulated carrier wave;

a first to Nth additional carrier wave generating means for generating first to Nth carrier waves respectively;

a first to Nth additional amplitude modulation means, which are connected to the first to Nth additional carrier wave generating means respectively and to the first to Nth modulation signal generating means respectively, for amplitude modulating the first to Nth carrier waves respectively in accordance with respective first to Nth modulation signals and for delivering first to Nth amplitude-modulated carrier waves respectively; and mixing means for mixing the first to Nth amplitude modulated carrier waves and for delivering a mixed carrier wave, the mixed carrier wave being said modulation signal.

3. An electronic musical instrument according to claim 1 wherein said feedback means includes a delay circuit for performing said delaying.

4. An electronic musical instrument comprising:

keyboard means having a plurality of keys;

carrier wave generating means for generating a carrier wave corresponding to a depressed one of said keys;

modifying means for modifying said carrier wave in accordance with a modifying signal and for delivering a modified carrier wave;

modulation signal generating means for generating a modulation signal;

amplitude modulation means for amplitude-modulating said modified carrier wave by multiplying said modified carrier wave with said modulation signal, the resultant amplitude-modulated modified carrier wave being utilized to generate a musical tone signal; and feedback means for generating said modifying signal by delaying said amplitude-modulated modified carrier wave and providing said delayed amplitude-modulated modified carrier wave as said modifying signal.

5. An electronic musical instrument according to claim 4 wherein said feedback means comprises:

a modulation index generator for generating a modulation index; and a multiplier for multiplying said amplitude-modulated modified carrier wave with said modulation index, said multiplied amplitude-modulated modified carrier wave being provided as said modifying signal.

6. An electronic musical instrument according to claim 5 wherein said modulation index is a function of time.

7. An electronic musical instrument according to claim 4 wherein said feedback means comprises:

a modulation index generator for generating a modulation index;

a multiplier for multiplying said amplutide-modulated modified carrier wave with said modulation index; and modulation signal memory means for storing said modulation signal and for generating said modulation signal in accordance with a product output of said multiplier.

8. An electronic musical instrument according to claim 4 wherein said feedback means comprises:

a first to Nth modulation signal generating means (where N is an integer larger than 1) for generating respectively first to Nth modulation signals in accordance with said amplitude modulated modified carrier wave;

a first to Nth additional carrier wave generating means for generating first to Nth carrier waves respectively;

a first to Nth additional amplitude modulation means, which are connected to the first to Nth additional carrier wave generating means respectively and to the first to Nth modulation signal generating means respectively, for amplitude modulating the first to Nth carrier waves respectively in accordance with respective first to Nth modulation signals and for delivering first to Nth amplitude modulated modified carrier waves respectively;

mixing means for mixing the first to Nth amplitude modulated modified carrier waves and for delivering a mixed carrier wave, the mixed carrier wave being said modifying signal.

9. An electronic musical instrument according to claim 4, wherein the frequency of said modulation signal from said modulation signal generating means is related to the frequency of said carrier wave.

10. An electronic musical instrument according to claim 4 which is digital and wherein:

said carrier wave, said modified carrier wave, said modulation signal, said amplitude modulated carrier wave and said modifying signal all are represented as digital values at successive sample points occurring at regular time intervals, said carrier wave having a relatively simple waveform, said modification and amplitude modulation resulting in the production from said carrier wave of simple waveform of a resultant amplitude-modulated modified carrier wave having a relatively complex waveform appropriate for musical tone generation.

11. An electronic musical instrument according to claim 1 or 4 wherein said carrier wave generating means comprises:

a phase angle information generator for generating a phase angle information having a value which progresses at a rate corresponding to said depressed key, and carrier wave memory means connected to said phase angle information generator for storing said carrier wave and for generating said carrier wave whose period is determined by said rate upon reception of said phase angle information.

12. An electronic musical instrument according to claim 1 or 4 which further comprises means for imparting an envelope to said musical tone signal.

13. An electronic musical instrument according to claim 2 or 8 wherein the frequency of at least one additional carrier wave generating means is related to the frequency of said carrier wave.

14. An electronic musical instrument comprising:

carrier wave generating means for generating a carrier wave having a certain frequency;

amplitude modulation means for amplitude-modulating said carrier wave by multiplying said carrier wave with a modulation signal, the resultant signal being delivered as an amplitude-modulated carrier wave to be used for producing a musical tone signal; and feedback means for generating said modulation signal by delaying said amplitude-modulated carrier wave and providing said delayed amplitude-modulated carrier wave as said modulation signal, and wherein said feedback means comprises:

modulation index generating means for generating a modulation index; and a multiplier for multiplying said amplitude-modulated carrier wave by said modulation index, said multiplied amplitude-modulated carrier wave being delayed and provided as said modulation signal.

15. An electronic musical instrument according to claim 8 wherein said modulation index is a function of time.

16. An electronic musical instrument comprising:

carrier wave generating means for generating a carrier wave having a certain frequency;

amplitude modulation means for amplitude-modulating said carrier wave by multiplying said carrier wave with a modulation signal, the resultant signal being delivered as an amplitude-modulated carrier wave to be used for producing a musical tone signal; and feedback means for generating said modulation signal by delaying said amplitude-modulated carrier wave and providing said delayed amplitude-modulated carrier wave as said modulation signal, and wherein said feedback means comprises:

a modulation index generator for generating a modulation index;

a multiplier for multiplying said amplitude-modulated carrier wave with said modulation index, and modulation signal memory means for storing said modulation signal and for generating said modulation signal in accordance with a product output of said multiplier.

17. An electronic musical instrument according to claim 7 or 16 wherein said modulation index comprises a function of time.

18. An electronic musical instrument comprising:

keyboard means having a plurality of keys;

carrier wave generating means for generating a carrier wave having a frequency corresponding to a depressed one of said keys;

amplitude modulation means for amplitude-modulating said carrier wave in accordance with a modulation signal and for delivering an amplitude-modulated carrier wave to be used for producing a musical tone signal;

feedback means for generating said modulation signal in accordance with said amplitude-modulated carrier wave, and wherein said feedback means comprises:

a first to Nth modulation signal generating means (where N is an integer larger than (1) for generating first to Nth modulation signals respectively, said first modulation signal being generated in accordance with said amplitude-modulated carrier wave;

a first to N-1th additional carrier wave generating means for generating first to N-1th carrier waves respectively;

a first to N-1th additional amplitude modulation means, which are connected to the first to N-1th additional carrier wave generating means respectively and to the first to N-1th modulation signal generating means respectively, for amplitude modulating the first to N-1th carrier waves respectively in accordance with respective first to N-1th modulation signals and for delivering first to N-1th amplitude modulated carrier waves respectively, the first to N-1th amplitude modulated carrier waves being applied to the second to Nth modulation signal generating means respectively and the Nth modulation signal being said modulation signal.

19. An electronic musical instrument comprising:

keyboard means having a plurality of keys;

carrier wave generating means for generating a carrier wave corresponding to a depressed one of said keys;

modifying means for modifying said carrier wave in accordance with a modifying signal and for delivering a modified carrier wave;

modulation signal generating means for generating a modulation signal;

amplitude modulation means for amplitude-modulating said modified carrier wave in accordance with said modulation signal and for delivering an amplitude-modulated modified carrier wave utilized to generate a musical tone signal;

feedback means for generating said modifying signal in accordance with said amplitude-modulated modified carrier wave, and wherein said feedback means comprises:

a first to Nth modulation signal generating means (where N is an integer larger than (1) for generating first to Nth modulating signals respectively, said first modulation signal being generated in accordance with said amplitude-modulated modified carrier wave;

a first to N−1th additional carrier wave generating means for generating first to N−1th carrier waves respectively; and a first to N−1th additional amplitude modulating means, which are connected to the first to N−1th additional carrier wave generating means respectively and to the first to N−1th modulation signal generating means respectively, for amplitude-modulating the first to N−1th carrier waves respectively in accordance with the respective first to N−1th modulation signals and for delivering first to N−1th amplitude-modulated modified carrier waves respectively, the first to N−1th amplitude-modulated modified carrier waves being applied to the second to Nth modulation signal generating means respectively and the Nth modulation signal being said modifying signal.

20. An electronic musical instrument according to claim 18 or 19 wherein the frequency of at least one additional carrier generating means is related to the frequency of said carrier wave.

21. An electronic musical instrument comprising:

carrier wave generating means for generating a carrier wave having a certain frequency;

amplitude modulation means for amplitude-modulating said carrier wave by multiplying said carrier wave with a modulation signal, the resultant signal being delivered as an amplitude-modulated carrier wave to be used for producing a musical tone signal; and feedback means for generating said modulation signal by delaying said amplitude-modulated carrier wave and providing said delayed amplitude-modulated carrier wave as said modulation signal, and wherein;

said carrier wave is a digitalized carrier wave, and said amplitude modulation means and said feedback means are digitalized, and which further comprises;

an averaging circuit for eliminating undesirable hunting phenomena.

22. An electronic musical instrument according to claim 21 wherein said feedback means includes said averaging circuit.

23. An electronic musical instrument according to claim 21 wherein said averaging circuit is provided at the output side of said amplitude-modulation means.

24. An electronic musical instrument comprising:

carrier wave generating means for generating a carrier wave having a frequency corresponding to a selected note;

amplitude modulation means for multiplying said carrier wave by a modulation signal and for delivering the resultant signal as an amplitude-modulated carrier wave to be used for producing a musical tone signal; and feedback means for generating said modulation signal by multiplying said amplitude-modulated carrier wave by a selected modulation index, the resultant product being delayed and provided as said modulation signal.

25. An electronic musical instrument comprising:

carrier wave generating means for generating a carrier wave corresponding to a selected note;

modifying means for modifying said carrier wave in accordance with a modifying signal and for delivering a modified carrier wave;

modulation signal generating means for generating a modulation signal;

amplitude modulation means for multiplying said modified carrier wave with said modulation signal and for delivering the resultant signal as an amplitude-modulated modified carrier wave utilized to generate a musical tone signal; and feedback means for generating said modifying signal by multiplying said amplitude-modulated modified carrier wave by a selected modulation index, the resultant product being delayed and provided as said modifying signal.

26. A digital electronic musical instrument comprising:

carrier wave generating means for generating a carrier wave having a frequency corresponding to a selected musical note, said carrier wave being represented by successive sample point amplitude values provided at regular time intervals;

amplitude modulation means for amplitude-modulating said carrier wave by multiplying the sample point amplitude values of said carrier wave with a time sampled modulation signal, the resultant signals being delivered as sample point amplitude data of an amplitude-modulated carrier wave to be used for producing a musical tone signal; and feedback means for generating said modulation signal by delaying the sample point amplitude data of said amplitude-modulated carrier wave and providing said delayed amplitude-modulated carrier wave sample point amplitude data as said time sampled modulation signal;

whereby the tone color of a musical tone corresponding to said musical tone signal will vary according to the lapse of time.

27. An electronic musical instrument comprising:

carrier wave generating means for generating a carrier wave having a frequency corresponding to a selected musical note and having a relatively simple waveform;

amplitude modulation means for multiplying the successive amplitudes of said carrier wave with successive values of a modulation signal, the resultant successive signals being delivered as an amplitude-modulated carrier wave to be used for producing a musical tone signal; and feedback means for generating said modulation signal by delaying said amplitude-modulated carrier wave signals and providing said delayed amplitude-modulated carrier wave signals as said successive modulation signal values, whereby an amplitude-modulated carrier wave having a time varying complex waveform, suitable to production of a corresponding musical tone having a time varying tone color, is created out of a carrier wave of simple waveform.

28. An electronic musical instrument comprising:

carrier wave generating means for generating a carrier wave having a frequency corresponding to a selected musical note;

amplitude modulation means for multiplying the amplitudes of said carrier wave at regular time intervals within each cycle of said carrier wave with a modulation signal, the resultant signal being delivered as an amplitude-modulated carrier wave to be used as a musical tone signal; and feedback means for generating said modulation signal by modifying said amplitude-modulated carrier wave and providing said modifying amplitude-modulated carrier wave signals as said modulation signal, said modifying being one or both of delaying and multiplying by a selected modulation index value;

whereby said musical tone signal will exhibit a time varying waveshape and hence a musical tone corresponding to said musical tone signal will exhibit a time varying tone color.

29. In a digital electronic musical instrument, a system for producing a relatively complex musical tone waveform from a carrier wave of relatively simple waveform which is supplied as an input to said system, comprising:

means for multiplying successive amplitude samples of said carrier wave with successive values of a modulation signal, the resultant signals being used as a musical tone signal; and feedback means for delaying said resultant signals and providing said delayed resultant signals as said modulation signal successive values, said multiplying means and said feedback means being operative in real time and producing by said multiplying a musical tone signal having a waveform which varies with the lapse of time, so that the tone color of a musical tone corresponding to said musical tone signal likewise will vary with the lapse of time.

30. An electronic musical instrument comprising:

carrier wave generating means for generating a carrier wave having a certain frequency;

amplitude modulation means for amplitude-modulating said carrier wave by multiplying said carrier wave with a modulation signal, the resultant signal being delivered as an amplitude-modulated carrier wave to be used as a musical tone signal;

modifying means for modifying said amplitude-modulated carrier wave, said modifying being one or both of delaying and multiplying by a selected modulation index value; and modulation signal providing means for providing said modified amplitude-modulated carrier wave as said modulation signal, whereby the waveform of said delivered amplitude-modulated carrier wave, and hence the tone color of a musical tone corresponding thereto, will vary in accordance with the lapse of time.

31. An electronic musical instrument comprising:

carrier wave generating means for generating a carrier wave having a certain frequency;

amplitude modulation means for amplitude-modulating said carrier wave by multiplying said carrier wave with a modulation signal, the resultant signal being delivered as an amplitude-modulated carrier wave to be used as a musical tone signal;

feedback means for generating said modulation signal by modifying said amplitude-modulated carrier wave and providing said modified amplitude-modulated carrier wave as said modulation signal, said multiplication by said provided modulation signal thereby causing the waveform of said resultant signal to vary with lapse of time so that the tone color of a musical tone corresponding to said musical tone signal likewise will vary with lapse of time.

32. An electronic musical instrument according to claim 31, wherein said means for generating modifies said amplitude-modulated carrier wave by delaying the same.

33. An electronic musical instrument according to claim 31, wherein said means for generating modifies said amplitude-modulated carrier wave by multiplying the same by a modulation index.

34. An electronic musical instrument comprising:

carrier wave generating means for generating a carrier wave having a certain frequency;

amplitude modulation means for amplitude-modulating said carrier wave by multiplying said carrier wave with a modulation signal, the resultant signal being delivered as an amplitude-modulated carrier wave to be used as a musical tone signal;

feedback means for generating said modulation signal by delaying said amplitude-modulated carrier wave and providing said delayed amplitude-modulated carrier wave as said modulation signal;

said delaying and said multiplying causing said musical tone signal to have a waveshape which varies with lapse of time, so that the tone color of a musical tone corresponding to said musical tone signal likewise will vary with lapse of time.

* * * * *